US008360893B2

(12) United States Patent
Howard

(10) Patent No.: US 8,360,893 B2
(45) Date of Patent: Jan. 29, 2013

(54) ROLLER COASTER VEHICLE

(75) Inventor: Derek Howard, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 113 days.

(21) Appl. No.: 12/822,721

(22) Filed: Jun. 24, 2010

(65) Prior Publication Data

US 2011/0319178 A1 Dec. 29, 2011

(51) Int. Cl.
*A63G 1/28* (2006.01)
*A63G 1/00* (2006.01)

(52) U.S. Cl. ..... 472/43; 104/53

(58) Field of Classification Search ..... 472/43–45, 472/39, 57–59, 130; 104/53, 75
See application file for complete search history.

(56) References Cited

U.S. PATENT DOCUMENTS

| | | | | |
|---|---|---|---|---|
| 5,623,878 | A | 4/1997 | Baxter | |
| 6,158,354 | A | 12/2000 | Eiraku | |
| 6,269,749 | B1 * | 8/2001 | Hogg | 104/53 |
| 7,610,859 | B1 | 11/2009 | Dietrich | |
| 8,066,576 | B2 * | 11/2011 | Threlkel | 472/47 |
| 2002/0068641 | A1 | 6/2002 | Dicicco | |
| 2008/0173208 | A1 | 7/2008 | Heinrich | |

FOREIGN PATENT DOCUMENTS

| | | | |
|---|---|---|---|
| CH | 658431 | A5 | 11/1986 |
| DE | 8717429 | | 12/1988 |
| DE | 20021936 | U1 | 5/2002 |
| GB | 226914 | A | 1/1925 |
| NL | 9401636 | A | 4/1996 |
| WO | 03082421 | A2 | 10/2003 |
| WO | 2007055572 | | 5/2007 |
| WO | 2007139508 | | 12/2007 |

OTHER PUBLICATIONS

International Search Report, NL 1030415, dated Nov. 14, 2005.
Extended Search Report, EP 11170801, Oct. 27, 2011, 3 pages, Munich, Germany.
Roller Coaster Database, Orphan Rocker—Scenic World (Katoomba, New South Wales, Australia), Internet Publication by Duane Marden, available at http://rcd.com/1870.htm (last accessed on Dec. 10, 2012), Publication date 2002, 22 pages.

* cited by examiner

*Primary Examiner* — Kien Nguyen
(74) *Attorney, Agent, or Firm* — Ference & Associates LLC

(57) ABSTRACT

A ride system provides guest compartment(s) with a roll degree of freedom through a pivoting connection. The guest compartment is attached to a track via a chassis, the chassis being attached to the track such that the guest compartment rides substantially above the track but has a roll degree of freedom relative to the chassis.

16 Claims, 9 Drawing Sheets

ROLLER COASTER VEHICLE

FIELD OF THE INVENTION

The subject matter presented herein generally relates to vehicles for use in connection with rides, such as amusement park rides or theme park rides.

BACKGROUND

Parks, such as theme parks or amusement parks, are popular worldwide. Rides attract and entertain substantial numbers of visitors to the parks. Some guests particularly enjoy rides in which the riders travel along a track, for example as with roller coaster rides. There are different types of roller coasters; each having different components that can be used to categorize the different types in many ways. In each, one or more vehicles (cars) run along a track structure that is supported in some way (for example by a lattice similar to a beam framework that supports a building).

Roller coasters differ in how the vehicle(s) and components thereof interface with the track and/or how the guest compartment of the vehicle is mounted relative to the track. In each, the design is configured to keep the vehicle securely anchored to the track. In traditional roller coasters, the guest compartment of the vehicle is rigidly mounted to a chassis (that is, not having a degree of freedom there between) that follows the track layout below the vehicle's guest compartment. For example, many coasters mimic trains, having a set of vehicles that ride above a track. This provides a traditional and well known/familiar experience for the riders. Such a configuration is relatively predictable to the rider based on simply looking at the track in front of the vehicle. In some designs, however, the track may run above the vehicle (attach at the top of the vehicle), with the guest compartment hanging below, as in a ski lift. For example, in an inverted roller coaster, the hanging train is attached to the track running above.

Certain roller coaster designs have introduced a degree of freedom between the guest compartment and the chassis attached to the track, such that the guest compartment is not rigidly attached to the chassis. For example, a spinning roller coaster is a roller coaster with vehicles that rotate on a vertical axis relative to the chassis (and relative to the track). In suspension roller coasters, the hanging train of vehicles swing or roll about pivoted joints, with the guest compartments placed below the track, adding an additional side-to-side motion.

SUMMARY OF THE INVENTION

Embodiments of the invention broadly contemplate a ride system providing guest compartment(s) with a roll degree of freedom through a pivoting connection. A guest compartment is attached to a track via a chassis, the chassis being attached to the track such that the guest compartment rides substantially above the track, but has a roll degree of freedom relative to the chassis.

Embodiments are configured to provide guest compartments with a roll degree of freedom via use of a pivoting connection. For example, a bearing mount can be placed in a front portion and/or a rear portion of each vehicle's guest compartment, and can be disposed such that one or more pivot point(s) is/are created proximate to but above the center of gravity of the guest compartment. Embodiments therefore provide variability to the ride experience and help to control (for example, filter out) lateral accelerations on the guest by rolling the guest compartment, with or without damping and/or actuation, to compensate for, or add to, accelerations generated as the guest compartment of the vehicle moves along the track.

In summary, one aspect provides an apparatus comprising: a guest compartment; a chassis configured to travel along a track, the chassis having a support member portion and a portion configured to securely attach to the track; and a pivoting connection configured to connect the guest compartment and the support member portion such that a roll degree of freedom is imparted to the guest compartment; wherein the chassis and the guest compartment are configured such that the guest compartment is positioned above the track in an upright position.

Another aspect provides a ride system comprising: a plurality of vehicles; wherein at least one of the plurality of vehicles comprises: a guest compartment; a chassis configured to travel along the track, the chassis having a support member portion and a portion configured to securely attach to the track; and a pivoting connection configured to connect the guest compartment and the support member portion such that a roll degree of freedom is imparted to the guest compartment; wherein the chassis and the guest compartment are configured such the guest compartment is positioned above the track in an upright position.

A further aspect provides a ride system comprising: a plurality of vehicles; and one or more tracks; wherein at least one of the plurality of vehicles comprises: a guest compartment; a chassis configured to travel along one of the one or more tracks, the chassis having a support member portion and a portion configured to securely attach to the one of the one or more tracks; and a pivoting connection configured to connect the guest compartment and the support member portion such that a roll degree of freedom is imparted to the guest compartment; wherein the chassis and the guest compartment are configured such that the guest compartment is positioned above the track in an upright position.

The foregoing is a summary. For a better understanding of example embodiments, together with other and further features and advantages thereof, reference is made to the following description, taken in conjunction with the accompanying drawings, and the scope of the invention will be pointed out in the appended claims.

DETAILED DESCRIPTION

Figure 1:
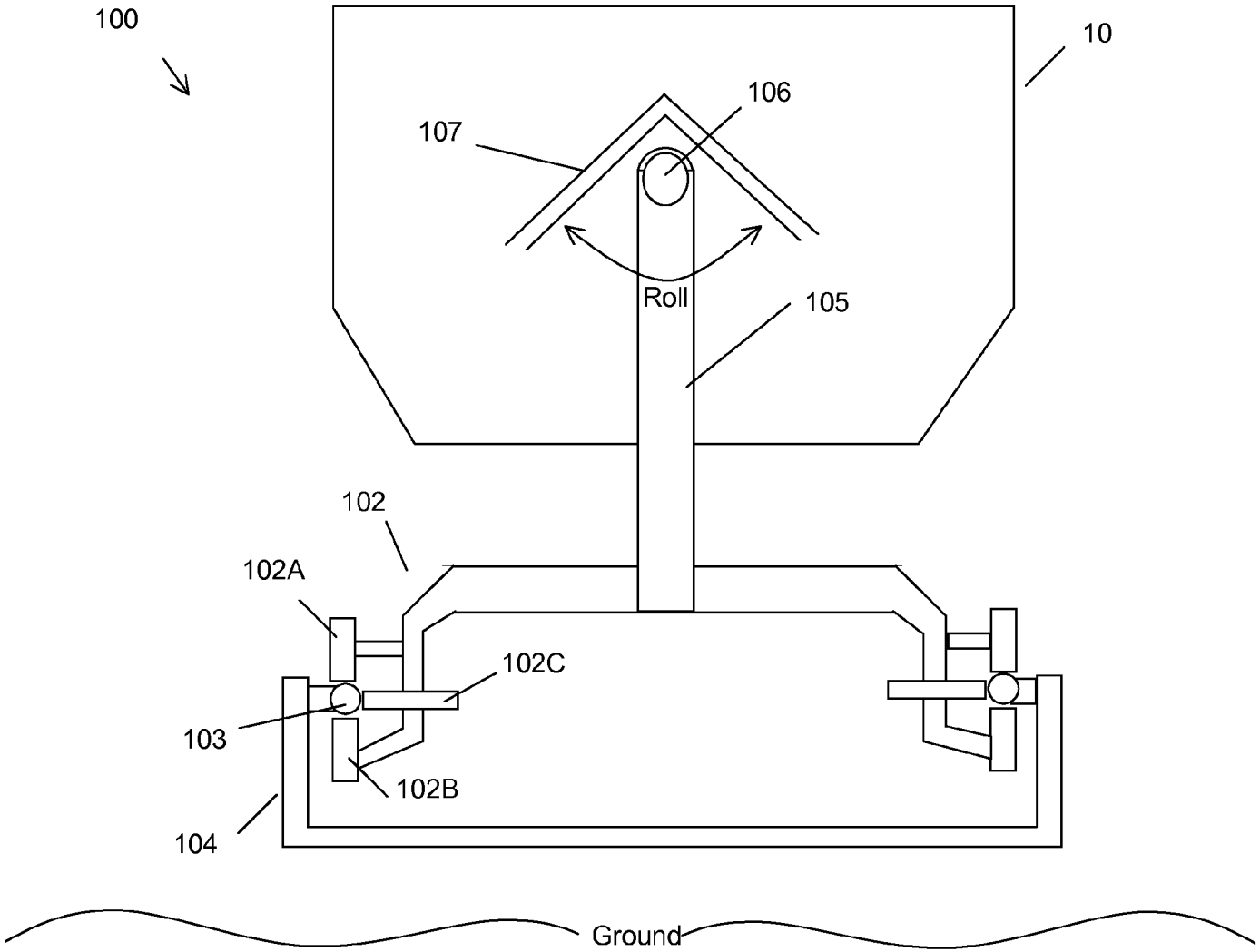
FIG. 1 illustrates a front view of an example vehicle with a roll degree of freedom.

Components of the embodiments, as generally described and illustrated in the figures herein, may be arranged and designed in a wide variety of different configurations in addition to the described example embodiments. Thus, the following more detailed description of example embodiments, as represented in the figures, is not intended to limit the scope of the invention, as claimed, but is merely representative of example embodiments.

Reference throughout this specification to embodiment(s) means that a particular feature, structure, or characteristic described in connection with the embodiment is included in at least one embodiment. Thus, appearances of the phrases "certain embodiments" or "example embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that various embodiments can be practiced without one or more of the specific details, or with other methods, components, materials, et cetera. In other instances, well-known structures, materials, or operations are not shown or described in detail to avoid obfuscation.

Traditional roller coaster vehicles/cars are configured such that the guest compartment is rigidly mounted to a chassis that follows a custom track layout. The inventors have recognized that while this provides a traditional and well-known experience that is relatively predictable to the guest, the lateral forces resultant from such rigid mounting can be uncomfortable, especially when over-the-shoulder restraints are used to secure guests within the guest compartment.

Moreover, while certain roller coaster configurations have employed a degree of freedom between the guest compartment and the chassis attaching the vehicle to the track, these configurations fall short in certain respects. For example, with spinning coasters, the movement of the vehicles is restricted in as much as the vehicle is not permitted to roll. Thus lateral accelerations are not controllable. In roller coaster configurations that permit roll, such as in a suspension roller coaster, the track is placed above the guest compartment and the attachment or pivot point for connection between the guest compartment and the chassis is placed relatively distant from the center of gravity of the guest compartment. Such a distant placement of the attachment point offers a variation or difference in dynamic characteristics as compared with a placement closer to the center of gravity of the guest compartment. For example, as the attachment point and creates a pendulum, distant placement of the attachment point relative to the center of gravity offers a different characteristic of roll as compared to an attachment point placed closer to the center of gravity. Moreover, placement of the track above the guest compartment is not desirable in some circumstances for a variety of reasons, for example losing the familiar above-the-track characteristic certain riders desire.

Accordingly, embodiments are directed to systems and methods providing amusement park rides having variability of guest experience via a guest compartment configured to ride above a track with a roll degree of freedom relative to a connection (chassis) with the track. A roll degree of freedom is defined herein as a degree of freedom between a guest compartment and a chassis attaching to the track, permitting rolling motion for the guest compartment relative to the chassis about an axis running parallel to the track. The roll degree of freedom therefore imparts (perpendicular) roll to the guest compartment about the axis running parallel to the track. The guest compartment is pivotally attached to a chassis, which is in turn attached to the track, with certain embodiments providing a guest compartment having a roll degree of freedom by virtue of a bearing mount configuration. The bearing mount configuration can take a variety of forms, including but not limited to one or more mountings positioned at the front and/or rear of each vehicle's guest compartment, with or without damping and/or actuating components.

Embodiments provide a roll degree of freedom to the guest compartment to control (for example, filter) lateral accelerations on the guest compartment. The controlling of lateral accelerations is achieved by permitting the guest compartment to roll, at least within a limited range, to compensate for, or add to, forces placed on the guest compartment throughout its travel along the track. Certain embodiments provide controlled rolling motions to the guest compartment for modified and/or planned rolling motions, as suitable for allowing a reduced or an increased range of roll. Such controlled rolling motions are useful in contexts such as with a theme ride having custom scenery for which planned orientation changes for the guest compartment are desirable to provide varying views of, and proximity to, the custom scenery.

Rolling motions can be varied by appropriate configuration of the pivoting connection, the guest compartment, the track, and combinations thereof. By way of example, controlled rolling motions can be achieve passively, as by permitting the guest compartment to roll within a limited range by virtue of an additional element (such as a limiting arrangement) and track design that, due to the force of gravity and inertia of the guest compartment, imparts varying forces to the guest compartment as it travels. Thus passive control of rolling motions can be achieved for example via use of limiting arrangement(s) and/or damping arrangement(s), as further described herein. Moreover controlled rolling motions can be achieved actively, as for example by imparting motion to the guest compartment via a motor configured to impart roll to the guest compartment throughout the guest compartments travel along the track. Active control of rolling motions can be achieved via use of actuator(s), as described further herein.

As will be apparent to those having ordinary skill in the art, various components described herein can be provided as separate elements or integrated with other described elements, depending on the particular use context contemplated, materials and design chosen, and the like, so long as the desired functionality is achieved. Non-limiting examples of suitable configurations are described throughout.

For the purposes of this description, directional terms such as "above", "below" and the like are used as terms of direction when a roller coaster vehicle is in an upright position or orientation relative to the ground, as illustrated in FIG. 1. Thus, the term "above", for example, means higher than the referenced element(s) with respect to the ground when in an upright position or orientation relative to the ground. The figures illustrate upright positions relative to the ground and the terms "above", "below" and the like are used in this context; however, it will be appreciated by those having ordinary skill in the art that if loops (or turns or the like) of the track are introduced, the terms "above", "below" and the like will take on a different meaning depending on the position or orientation with respect to the ground.

Referring to FIG. 1, an example embodiment of a roller coaster vehicle 100 is illustrated. A front view of the vehicle 100 is illustrated. The vehicle 100 is configured to ride above a track 104. The vehicle 100 includes a guest compartment 101 attached to a chassis 102 via a support member portion 105. The chassis 102 can be configured in a wide variety of ways, including having an integral support member portion and integral wheel assembly portion. The choice of the chassis configuration, as with other components described in connection with example embodiments herein, can vary depending upon a variety of factors, such as the nature of the track structure employed and/or the particular use or type of ride contemplated. Non-limiting example use contexts and ride types are provided throughout to facilitate understanding of embodiments described herein.

As illustrated in FIG. 1, chassis 102 includes three wheels (102*a*, 102*b*, and 102*c*) that are configured above, below and inside a track tube 103, respectively. The positioning of the wheels 102*a*, 102*b*, and 102*c* is suitable to permit attachment or coupling such that the vehicle 100 travels along the track 104 by riding atop the track tube 103, and the chassis 102 is securely coupled to the track tube 103. The configuration shown in FIG. 1 constrains movement such that the chassis 102 is not permitted to lift off of the track 104 (by virtue of wheel 102*b*) or move laterally (by virtue of wheel 102*c*). Other configurations for the chassis 102 are possible, including use of other components and/or different positioning of those components, so long as a secure, constrained coupling that permits rolling and smooth interface between chassis 102 and track 104 is obtained.

Embodiments are configured to provide a guest compartment, such as guest compartment 101, with a roll degree of freedom relative to a chassis 102. Again, the roll degree of freedom is about an axis that runs parallel to the track such that the guest compartment 101 rolls as indicated by the double arrow in FIG. 1. As illustrated in FIG. 1, this roll degree of freedom can be imparted by providing a bearing mount 106. The bearing mount attaches the support member portion 105 to the guest compartment 101. The bearing mount 106 allows rotation (roll) of the guest compartment 101 about a pivot point collocated with bearing mount 106, as illustrated in FIG. 1.

Figure 3:
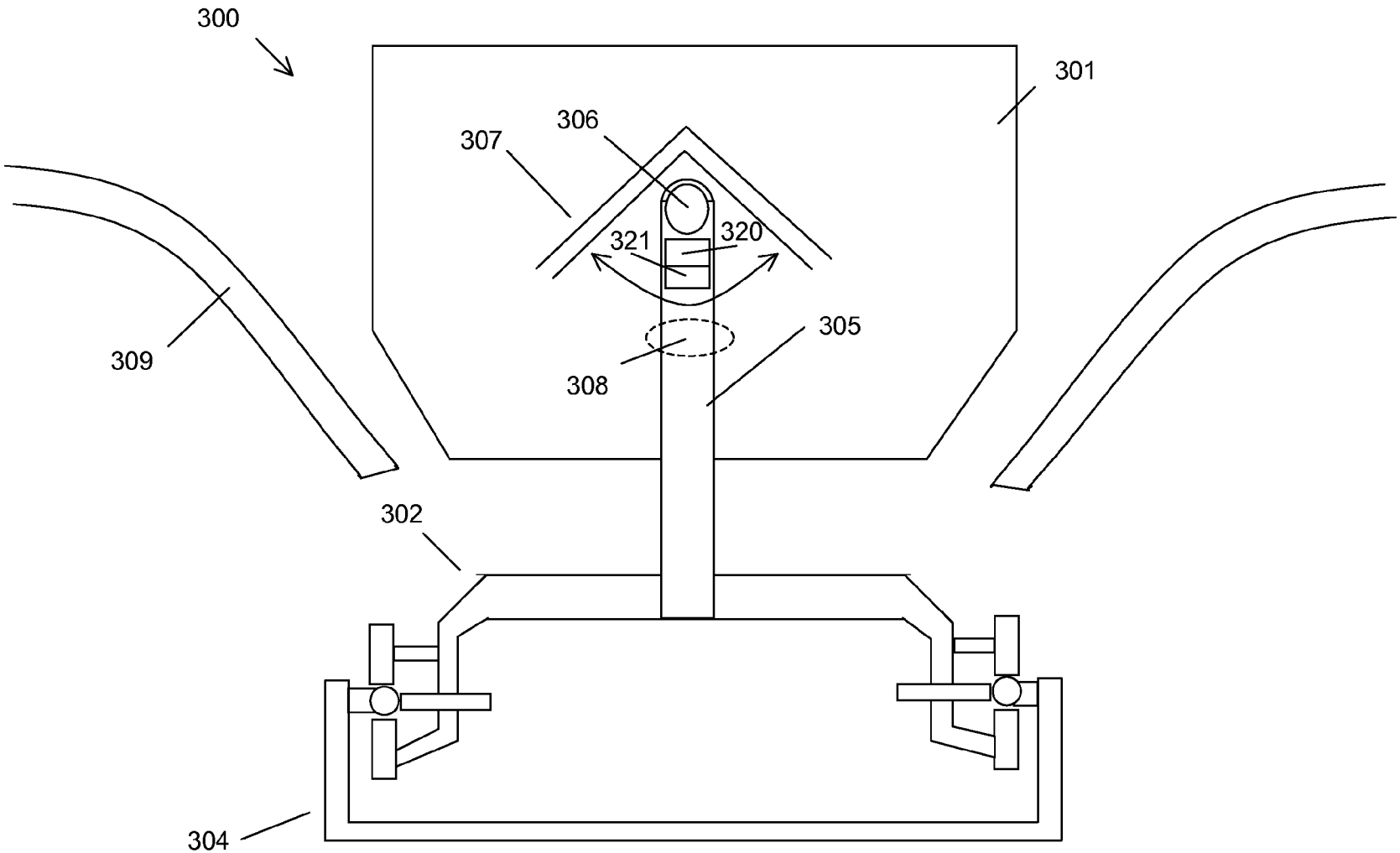
FIG. 3 illustrates a front view of an example vehicle with a roll degree of freedom and situated in custom scenery.

The pivoting connection created via bearing mount 106 likewise can take a variety of forms, for example including additional components such as damping arrangements (shown in FIG. 3) to reduce the amount of roll permitted by removing energy from the system (such as by imparting friction or resistance) or actuating arrangements for actively controlling the amount of roll (shown if FIG. 3). To provide an absolute limit to the amount of roll permitted, the guest compartment 101 can be configured with a stop or limiting arrangement 107 such that support member portion 105 abuts the limiting arrangement 107 on a maximum permissible roll. It is equally acceptable to configure the pivoting connection with a limiting arrangement integral thereto. Thus, embodiments can be configured with a bearing mount 106, support member portion 105 and limiting arrangement 107, with or without damping arrangements and/or actuators, to allow guest compartment 101 a roll degree of freedom within a predetermined range relative to the chassis 102.

In contrast to a guest compartment configured to hang below the track, as in a suspension roller coaster, embodiments are configured such that the guest compartment and other components (such as the chassis) remain oriented substantially above the track (again, as viewed in an upright position relative to the ground). A pivoting connection between the guest compartment and the chassis therefore remains oriented substantially above the track, as for example illustrated in FIG. 1.

Figure 2:
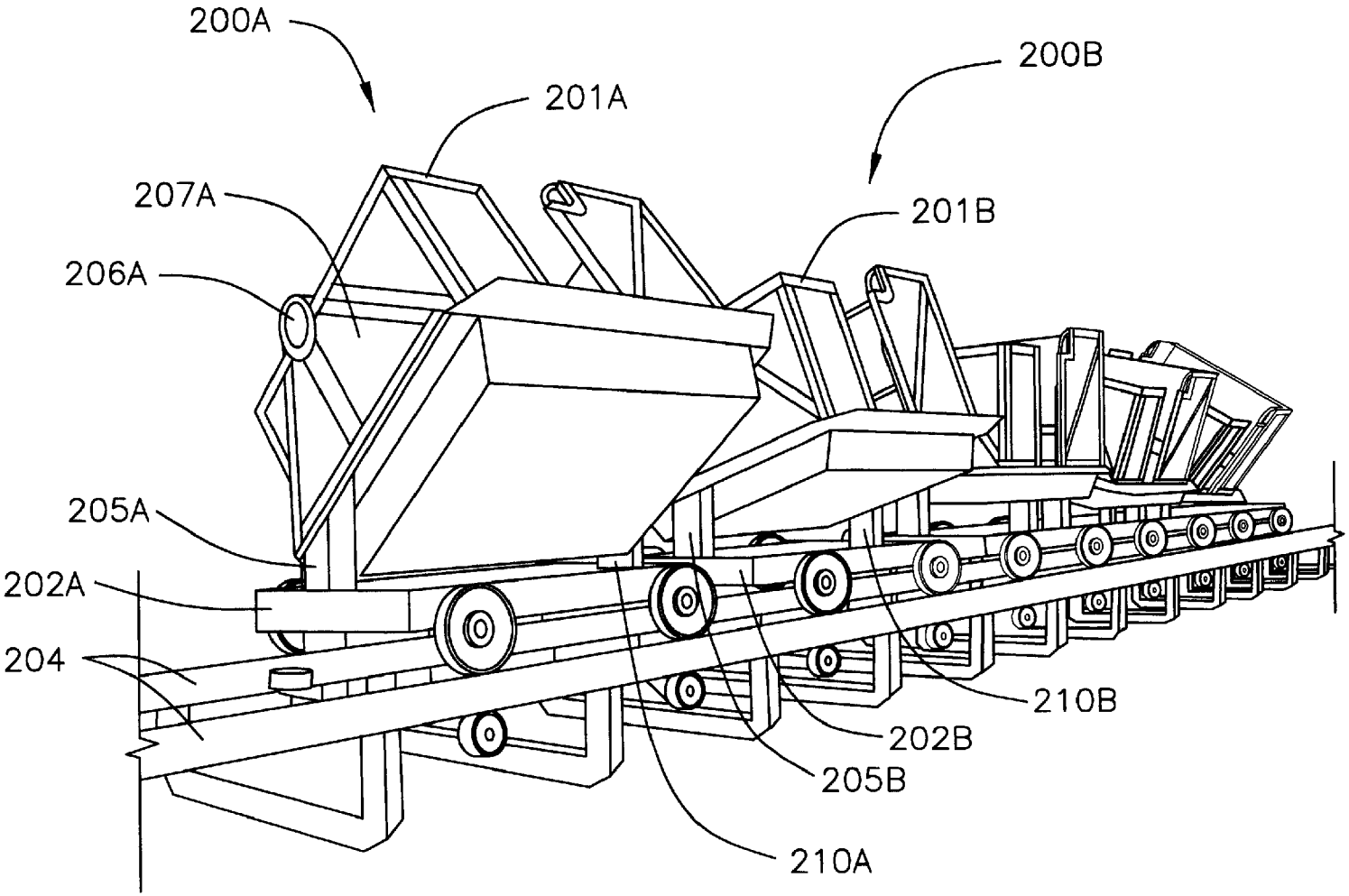
FIG. 2 illustrates an example of connected vehicles, each having a roll degree of freedom.

FIG. 2 illustrates a series of vehicles 200A, 200B connected as a train. Each of the vehicle guest compartment 201A, 201B has a roll degree of freedom and therefore rolls independently relative to its chassis. Each vehicle guest compartment 201A, 201B is permitted to roll independently because each is equipped with one or more separate pivoted connections (for example, bearing mount 206*a*). In the illustrated example configuration, each vehicle guest compartment 201A, 201B pivots about two bearing mounts, one disposed at the front of the guest compartment, and one disposed at the rear (for example, in vehicle 200A, these bearing mounts are located at distal ends of support member portions 205A, 210A).

Accordingly, guest compartment 201A is configured to roll about pivot points provided by bearing mounts attached to support member portions 205A, 210A as its chassis 202A moves along the track 204. The roll movement of guest compartment 201A is independent from the roll experienced by guest compartment 201B. Similarly, vehicle 200B can roll independently about pivot points provided by bearing mounts attached to support member portions 205B, 210B, such that guest compartment 201B has a roll degree of freedom relative to its chassis 202B as it moves along the track 204. Again, the amount of roll may be controlled responsive to the guest compartment's own movement by providing a limiting arrangement 207A, damping arrangement(s) (not shown), or even controlled actively by providing an arrangement such as an actuator (described further herein) powering the roll of the guest compartment 201A. Similar to the example embodiment illustrated in FIG. 1, guest compartments 201A, 201B, though permitted to roll, remain substantially above the track 204.

Referring to FIG. 3, a front view of a roller coaster vehicle 300 is illustrated. The vehicle guest compartment 301 is provided with a roll degree of freedom relative to its chassis 302 by virtue of the pivot point of the bearing mount 306, and is connected to the chassis 302 via the support member portion 305. Thus, while the chassis 302 is attached to the track 304 below, the guest compartment 301 is provided with a roll degree of freedom.

The positioning of the bearing mount is configurable (for example by one building the roller coaster to suit a particular ride context); however, in certain contexts such as that shown in FIG. 3, it is preferably proximate to, for example within 1-5 feet above, a center of gravity 308 for the (unloaded) guest compartment 301. To keep the guest compartment 301 from tipping, the pivot point (collocated with bearing mount 306 in this example) needs to be placed appropriately considering the center of gravity 308 (and other forces as the vehicle 300 moves along the track 304). Typically, this is adequately handled by placing a pivot point above the center of gravity, but can be ensured by use of a limiting arrangement 307. As described herein, placement of the pivot point at a position far above the center of gravity results in particular dynamic characteristics that are undesirable. Accordingly, certain embodiments provide a bearing mount 306 disposed proximate to the center of gravity 308.

The control of the amount of roll permitted about the pivoting connection is configurable in a variety of ways. As described, limiting arrangement(s) 307 can provide an absolute maximum limit for the amount of roll permitted. Moreover, a damping arrangement 320 may be employed to reduce (passively) the amount of and/or nature of roll permitted. For example, resistance can be imparted by a damping arrangement 320 such that the roll is slowed and/or reduced. Examples of suitable damping arrangements 320 are know to include but are not necessarily limited to rotation dampers such as hydraulic cylinder(s) or eddy current assemblies. The dampening arrangements 320 can be positioned in a variety of ways and/or integrated with other elements, so long as the function of removing energy from the pivoting connection is achieved.

Moreover, certain embodiments are configured to include active control or actuation of the amount of roll permitted via use of an actuator 321. For example, in a theme ride having custom scenery elements, such as a track cover 309 disposed between a custom track 304 and the guest compartment 301, actively controlling the amount of roll for the guest compartment 301 can be desirable to customize the ride. For example, in a theme ride having custom scenery elements, it may be desirable to orient the guest compartment in a particular way to maximize interaction with the custom scenery employed.

Accordingly, embodiments of the invention are configured to provide active control to actuate the guest compartment's 301 movement relative to the support member portion 305/chassis 302. Any of a wide variety of known devices may be employed to implement actuators 321. Examples of devices suitable for use as actuators 321 include but are not limited to hydraulic, electronic or pneumatic cylinder(s), and/or a linear electric motor assembly such as a linear induction motor (LIM) assembly or a linear synchronous motor (LSM) assembly. Control of the actuator(s) 321 is configurable (for example by one building the roller coaster to suit a particular ride context), such as via use of actuator(s) responsive to sensors, responsive to external triggers, responsive to show control, or a combination of these. The actuators 321 can be positioned in a variety of ways and/or integrated with other elements, so long as the function of actively controlling the rolling motion is achieved.

Figure 4A:
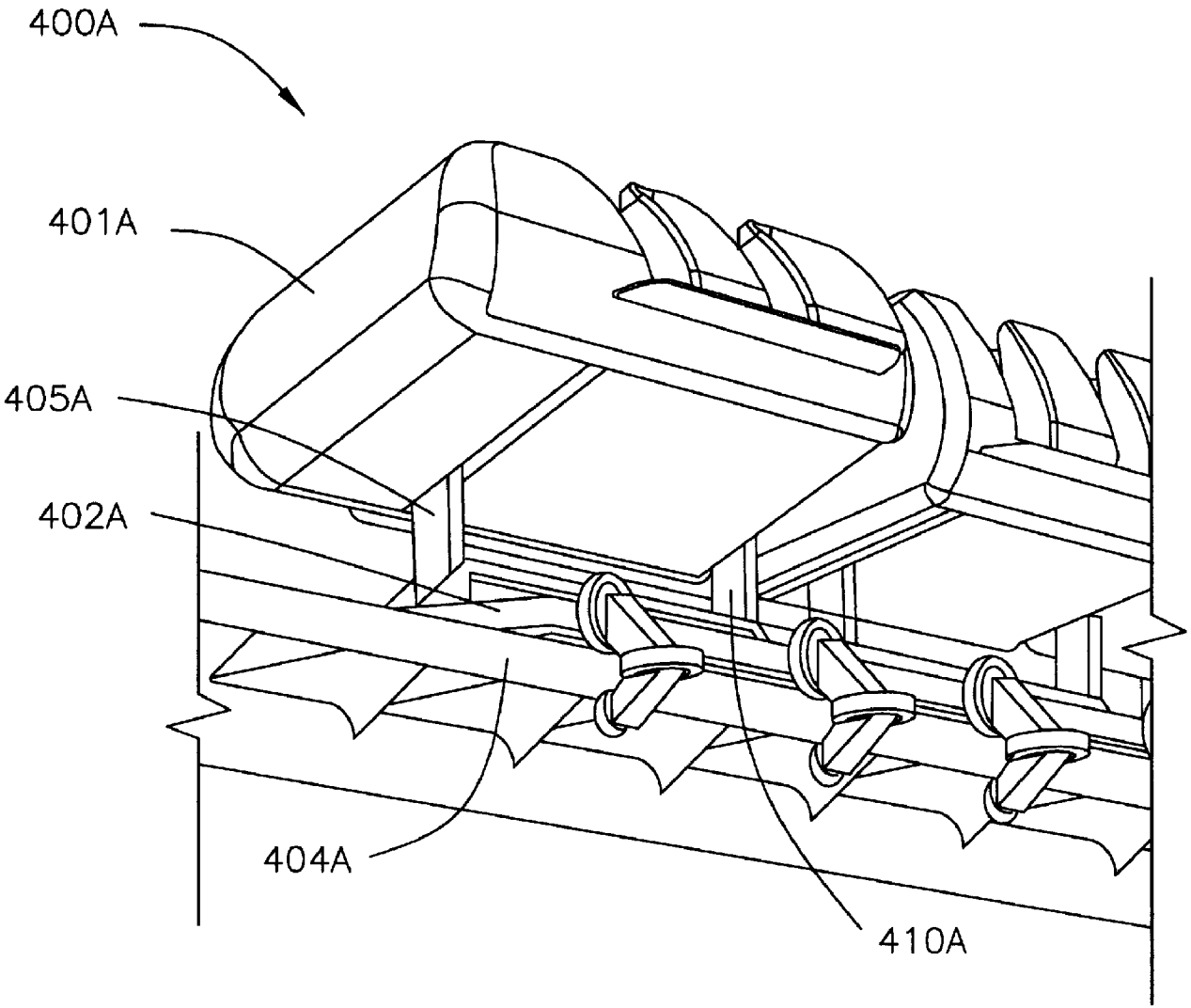
FIG. 4(A-B) illustrates perspective and cross section views of example connected vehicles, each having a roll degree of freedom.
Figure 4B:
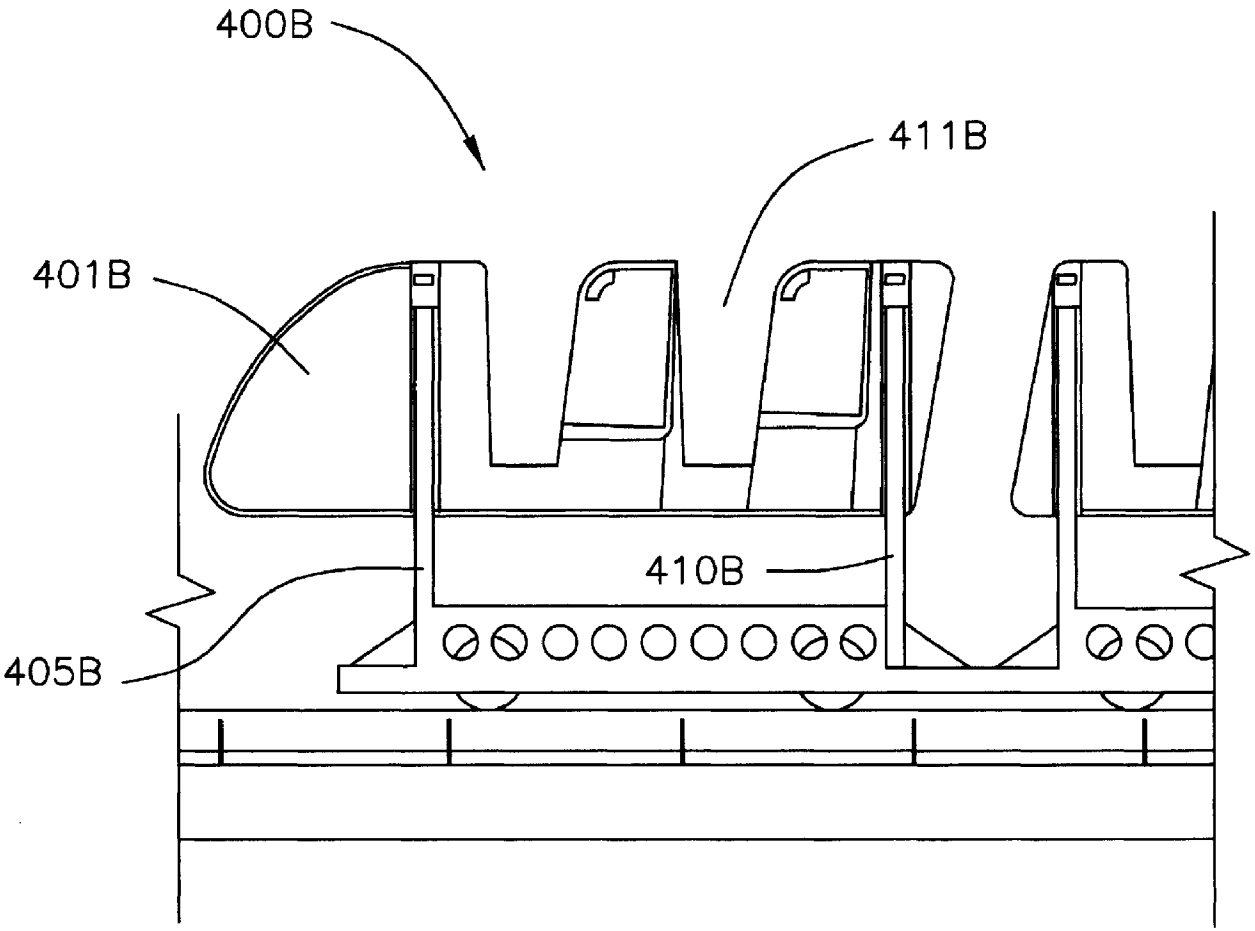

Referring now to FIG. 4A-B, example embodiments of vehicles 400A, 400B having a roll degree of freedom are illustrated. In FIG. 4A-B, the roll mechanism (for example, upper portion of support arms 405A, 410A and pivoting attachments) is hidden or shielded by the guest compartment 400A, as further described herein.

In FIG. 4A, a vehicle 400A in a series of connected vehicles is illustrated. The vehicle 400A is configured to couple to a track 404A via a chassis 402A. The chassis 402A is coupled to the track 404A and coupled to the guest compartment 401A via support member portions 405A, 410A. In FIG. 4A, support member portion 405A is attached to the guest compartment 401A via an attachment point within the guest compartment's 401A front portion. Another support member portion 410A is attached to the guest compartment 401A at an attachment point disposed near the rear portion of the guest compartment 401A. FIG. 4B illustrates a side cross section view of a vehicle 400A. As shown in FIG. 4B, both support arms 405B, 410B are configured to attach to the guest compartment 401B such that each is shielded and sealed off from an inner guest compartment 411B where a guest would sit.

Figure 5:
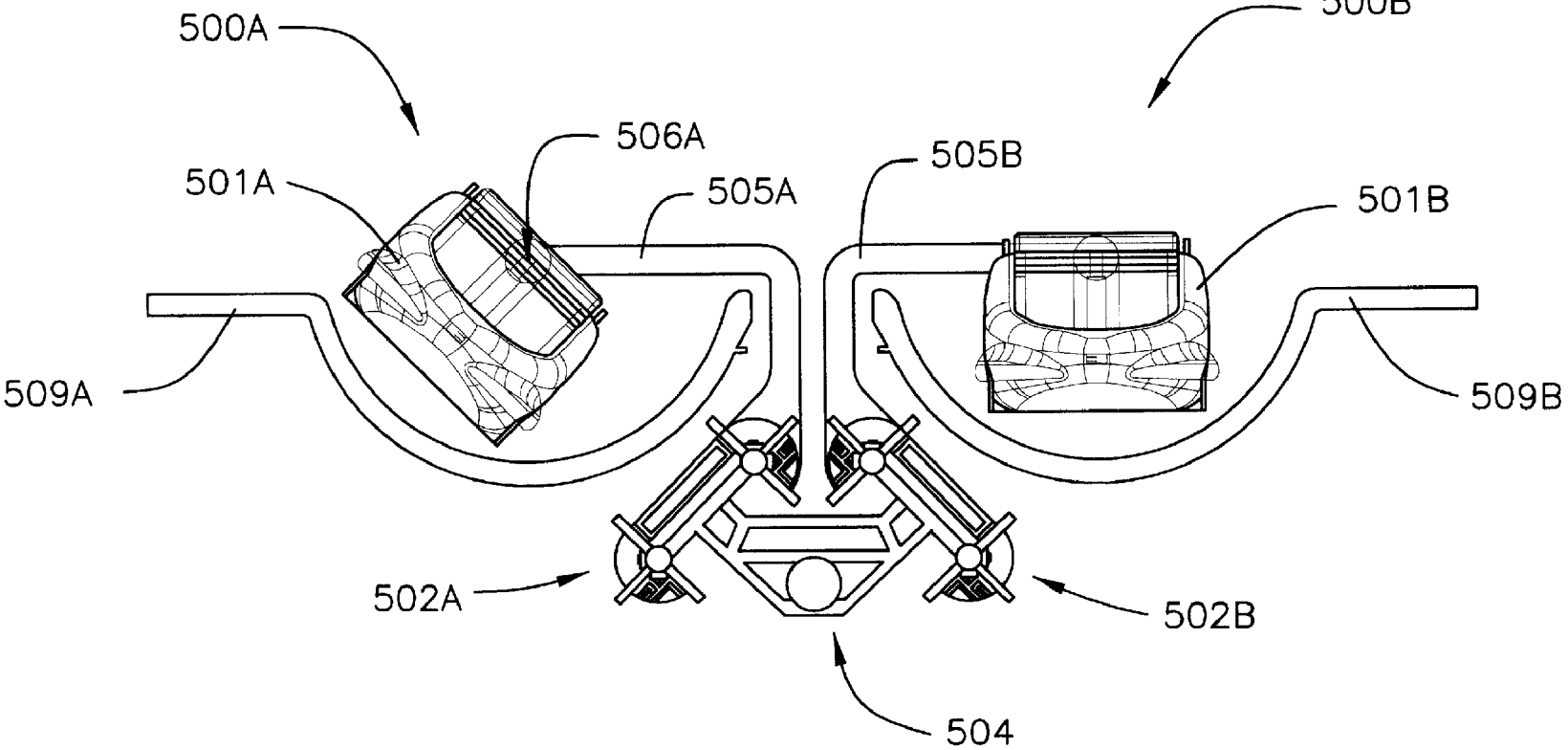
FIG. 5 illustrates a front view of example vehicles, each having a roll degree of freedom and situated in custom scenery.

FIG. 5 illustrates a front view of pair of vehicles 500A, 500B, arranged side by side, each having a roll degree of freedom. Vehicle 500A has a guest compartment 501A pivotally attached to a chassis 502A via a cantilever support member portion 505A. The pivotal attachment point (position indicated by arrow element 506A) can again be accomplished via a bearing mount, as for example via a single bearing mount positioned at the rear of the vehicle's guest compartment 501A. Vehicle 500A is illustrated as having its guest compartment 501A rolled or rotated about the pivot point approximately 45 degrees. This roll freedom can again be achieved passively or be a result of actuation via an actuator arrangement (not shown). Again, the guest compartment 501A of vehicle 500A remains substantially above the track.

In FIG. 5 another vehicle 500B is configured in a "racer" (side by side) arrangement with vehicle 500A. As illustrated, vehicle 500A and vehicle 500B can be configured to run along the same track arrangement 504, though these vehicles 500A, 500B could be configured to run on separate tracks. Vehicle 500B likewise has its guest compartment 501B pivotally attached to a chassis 502B via a cantilever support member portion 505B. As illustrated, each vehicle 500A, 500B has the track arrangement 504 hidden by track covers 509A, 509B, respectively. The track covers 509A, 509B can support custom scenery per the particular use context desired (the context illustrated is a bobsled style racing configuration).

Figure 6:
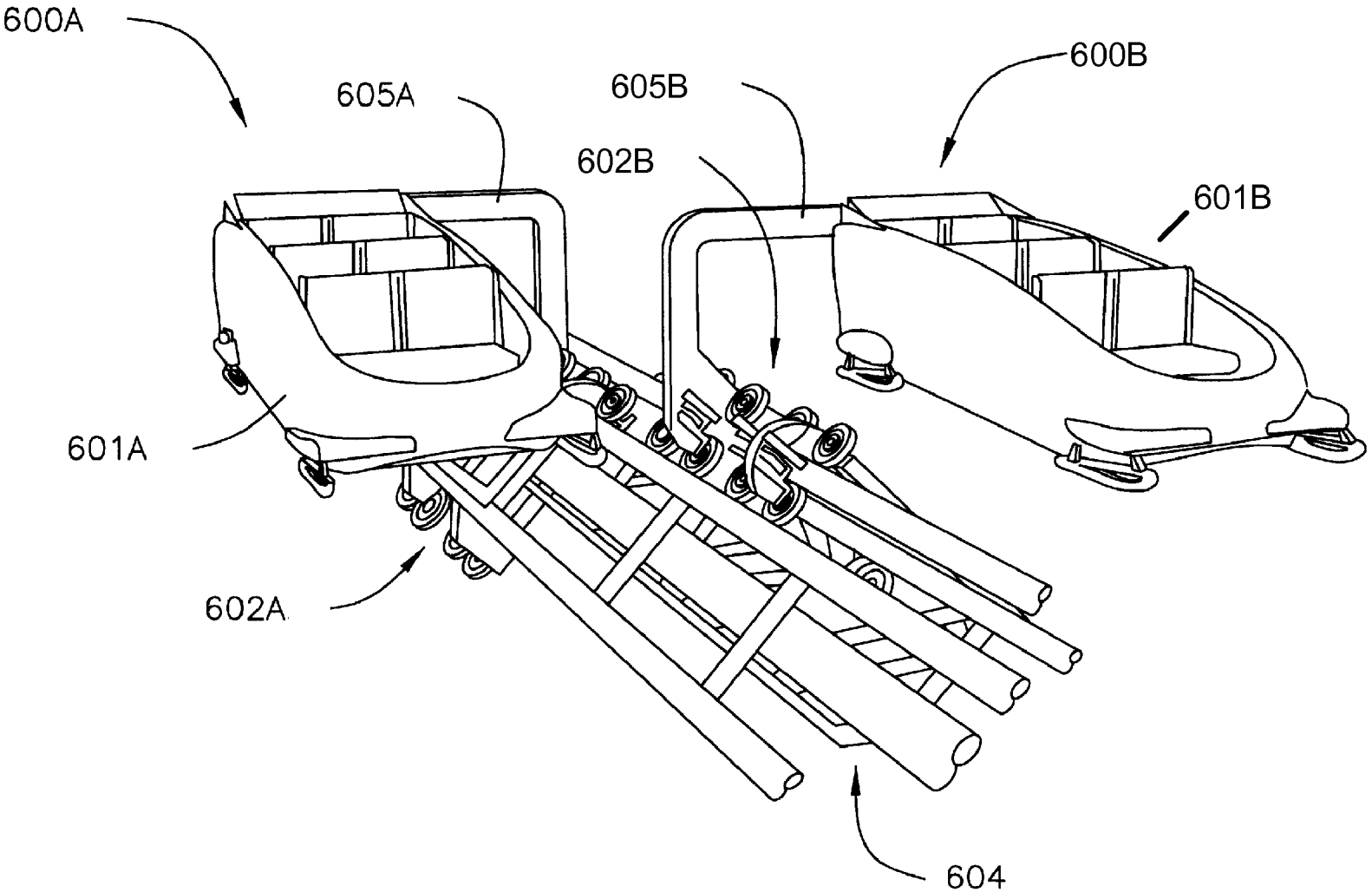
FIG. 6 illustrates a front perspective view of example vehicles, each having a roll degree of freedom.

FIG. 6 illustrates a pair of vehicles 600A, 600B, each having a roll degree of freedom. FIG. 6 provides a front-perspective view of the pair of vehicles 600A, 600B attached to a common track 604. The vehicles 600A, 600B illustrated are similar to the vehicles 500A, 500B of FIG. 5, but the track cover has been omitted from FIG. 6. Each vehicle's guest compartment 601A, 601B is pivotally attached to a chassis 602A, 602B, respectively, via a single cantilever support member portion 605A, 605B, respectively. Each vehicle 600A, 600B is configured with guest compartments 601A, 601B, cantilever support member portions 605A, 605B, and chassis 602A, 602B, respectively, such that the guest compartments 601A, 601B remain oriented substantially above the track 604.

Figure 7:
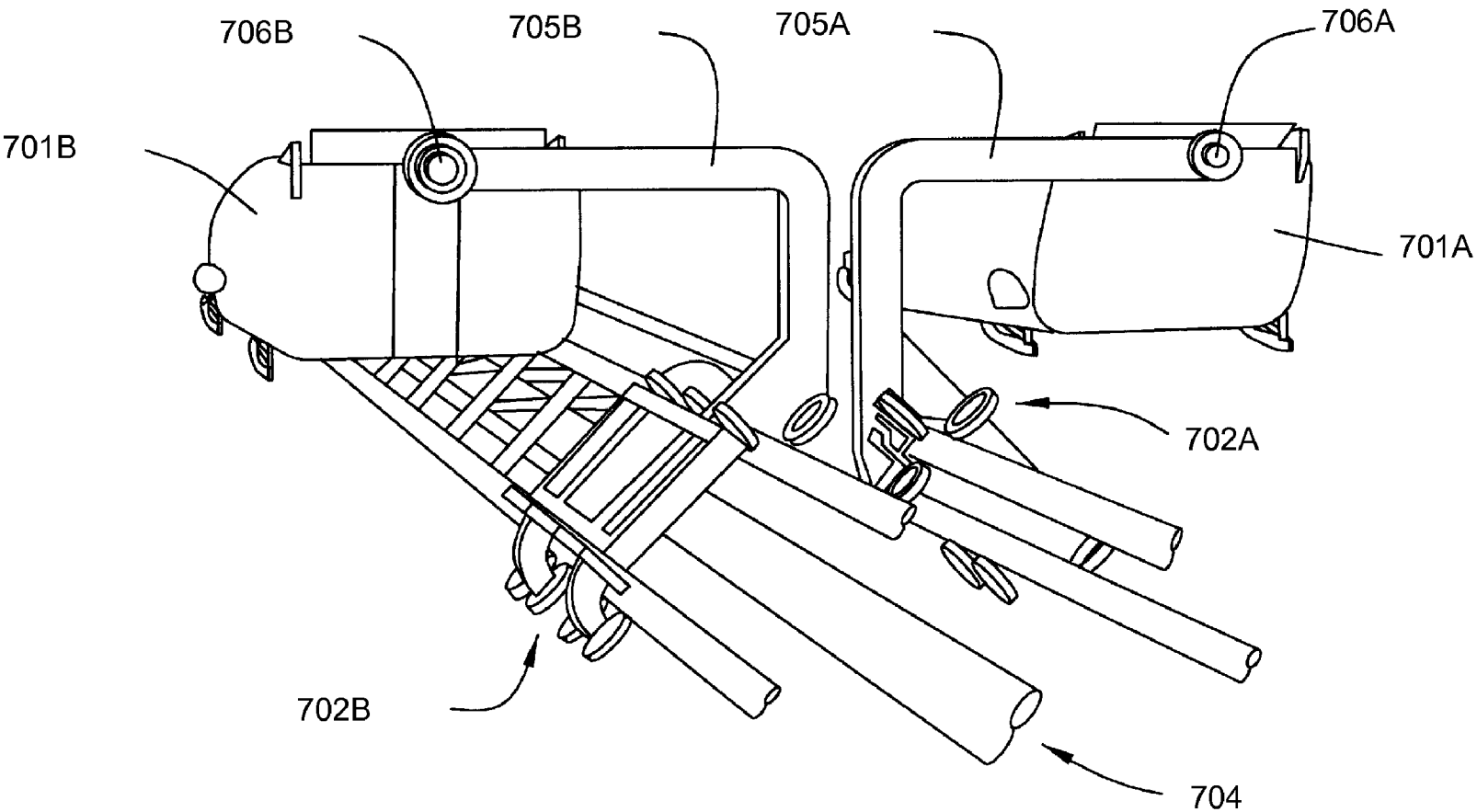
FIG. 7 illustrates a back perspective view of example vehicles, each having a roll degree of freedom.

FIG. 7 illustrates the vehicles 600A, 600B of FIG. 6 in a rear perspective view. As illustrated in the rear perspective view of FIG. 7, each cantilever support member portion 705A, 705B is pivotally attached to an upper portion of each guest compartment 701A, 701B, respectively, with a bearing mount 706A, 706B, respectively. This creates pivot points allowing a roll degree of freedom for the guest compartments 701A, 701B, while maintaining a rigid attachment to the track 704 for each vehicle's chassis 702A, 702B, respectively. As in FIG. 6, each vehicle 700A, 700B is configured with guest compartments 701A, 701B, cantilever support member portions 705A, 705B, and chassis 702A, 702B, respectively, such that the guest compartments 701A, 701B remain oriented substantially above the track 704.

Figure 8:
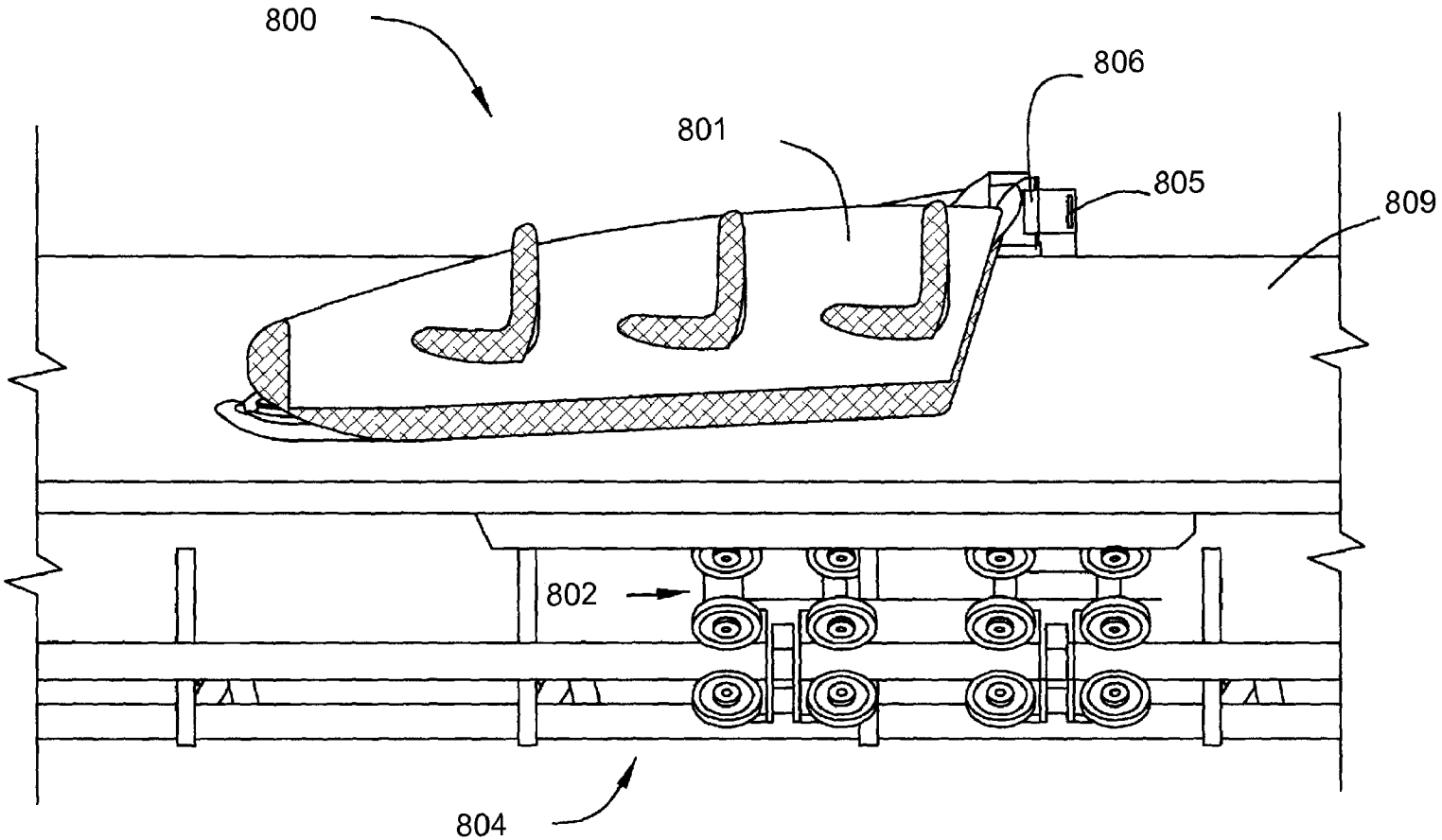
FIG. 8 illustrates a cross section view of an example vehicle having a roll degree of freedom and situated in custom scenery.

Referring to FIG. 8, a side cross-section view of a vehicle 800 having a roll degree of freedom is illustrated. The vehicle 800 of FIG. 8 is similar to the vehicles illustrated in FIGS. 5-7. The vehicle's guest compartment 801 is pivotally attached via a single bearing mount 806 to a cantilever support member portion 805. The bearing mount 806 is placed at the rear of the vehicle's guest compartment 801 such that it is shielded from guests' reach. The single bearing mount 806 is positioned proximate to (but above) the center of gravity of the guest compartment, thus enabling the guest compartment 801 to roll with a high degree of responsiveness to forces imparted on the vehicle 800, such as when the vehicle 800 travels down the track 804. The cantilever support member portion 805 is configurable (for example by one building the roller coaster to suit a particular ride context). As illustrated in this example, cantilever support member portion 805 is configured to wrap around a track cover 809 and attach to a track 804 located below the guest compartment 801. The chassis 802 securely attaches to the track 804.

In brief recapitulation, embodiments are directed to systems for amusement park rides providing variability of guest experience via a guest compartment configured to ride above a track and have a roll degree of freedom relative to a connection (chassis) with a track. Certain embodiments provide a guest compartment having a roll degree of freedom by virtue of a bearing mount configuration. The bearing mount configuration can take a variety of forms, including but not limited to one or more mountings positioned at the front and/or rear of each vehicle's guest compartment.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative embodiments have been described herein with reference to the accompanying drawings, it is to be understood that the embodiments are not limited to those precise embodiments, and that various other changes and modifications may be affected therein by one skilled in the art without departing from the scope or spirit of the disclosure.

What is claimed is:

1. An apparatus comprising:

a guest compartment;

a chassis configured to travel along a track, the chassis having a support member portion to connect the chassis and the guest compartment and a portion configured to securely attach to the track; and a pivoting connection configured to connect the guest compartment and the support member portion;

the pivoting connection being positioned above the center of gravity of the guest compartment and configured such that a roll degree of freedom about an axis that runs parallel to the track is imparted to the guest compartment; and the guest compartment including a limiting arrangement configured to contact the support member and provide passive control of the roll degree of freedom of the guest compartment;

wherein the chassis and the guest compartment are configured such that the guest compartment is positioned above the track in an upright position.

2. The apparatus according to claim 1, further comprising:

a second support member portion; and a second pivoting connection configured to connect the guest compartment and the second support member portion.

3. The apparatus according to claim 2, wherein the pivoting connection is disposed within a rear portion of the guest compartment and the second pivoting connection is disposed within a front portion of the guest compartment.

4. The apparatus according to claim 1, wherein the pivoting connection is configured to control rolling of the guest compartment.

5. The apparatus according to claim 4, wherein the pivoting connection is configured to dampen rolling of the guest compartment.

6. The apparatus according to claim 4, wherein the pivoting connection is configured to actuate rolling of the guest compartment.

7. The apparatus according to claim 1, wherein the pivoting connection is positioned at an upper portion of the guest compartment.

8. The apparatus according to claim 1, wherein the pivoting connection is positioned not more than one foot above the center of gravity of the guest compartment.

9. A ride system comprising:

a plurality of vehicles;

wherein at least one of the plurality of vehicles comprises:

a guest compartment;

a chassis configured to travel along a track, the chassis having a support member portion to connect the chassis and the guest compartment and a portion configured to securely attach to the track; and a pivoting connection configured to connect the guest compartment and the support member portion;

the pivoting connection being positioned above the center of gravity of the guest compartment and configured such that a roll degree of freedom about an axis that runs parallel to the track is imparted to the guest compartment; and the guest compartment including a limiting arrangement configured to contact the support member and provide passive control of the roll degree of freedom of the guest compartment;

wherein the chassis and the guest compartment are configured such the guest compartment is positioned above the track in an upright position.

10. The ride system according to claim 9, wherein the pivoting connection is configured to dampen rolling of the guest compartment.

11. The ride system according to claim 9, wherein the pivoting connection is configured to actuate rolling of the guest compartment.

12. A ride system comprising:

a plurality of vehicles; and one or more tracks;

wherein at least one of the plurality of vehicles comprises:

a guest compartment;

a chassis configured to travel along a track of the one or more tracks, the chassis having a support member portion to connect the chassis and the guest compartment and a portion configured to securely attach to the track; and a pivoting connection configured to connect the guest compartment and the support member portion;

the pivoting connection being positioned above the center of gravity of the guest compartment and configured such that a roll degree of freedom about an axis that runs parallel to the track is imparted to the guest compartment; and the guest compartment including a limiting arrangement configured to contact the support member and provide passive control of the roll degree of freedom of the guest compartment;

wherein the chassis and the guest compartment are configured such that the guest compartment is positioned above the track in an upright position.

13. The ride system according to claim 12, wherein the at least one of the plurality of vehicles further comprises:

a second support member portion; and a second pivoting connection configured to connect the guest compartment and the second support member portion;

wherein the pivoting connection is disposed within a rear portion of the guest compartment and the second pivoting connection is disposed within a front portion of the guest compartment.

14. The ride system according to claim 12, wherein the pivoting connection is configured to dampen rolling of the guest compartment.

15. The ride system according to claim 12, wherein the pivoting connection is configured to actuate rolling of the guest compartment.

16. The ride system according to claim 12, wherein at least a portion of the one or more tracks is covered by a track cover.

* * * * *